United States Patent [19]

Amano et al.

[11] 4,377,137

[45] Mar. 22, 1983

[54] METHOD FOR STARTING THE OPERATION OF AN INTERNAL COMBUSTION ENGINE

[75] Inventors: Matsuo Amano; Toru Sugawara, both of Hitachi; Yasunori Mouri; Yoshikazu Aochi, both of Katsuta; Shinichi Sakamoto, Hitachi, all of Japan

[73] Assignee: Hitachi, Ltd., Tokyo, Japan

[21] Appl. No.: 210,166

[22] Filed: Nov. 25, 1980

[30] Foreign Application Priority Data

Nov. 26, 1979 [JP] Japan ..... 54/152039

[51] Int. Cl.[3] ..... F02D 29/02

[52] U.S. Cl. ..... 123/179 B; 123/179 G; 123/491; 123/198 DB

[58] Field of Search ..... 123/179 B, 179 BG, 179 A, 123/179 G, 179 L, 491, 480, 198 DB, 198 DC, 198 D

[56] References Cited

U.S. PATENT DOCUMENTS

| | | | |
|---|---|---|---|
| 4,165,727 | 8/1979 | Fitzner et al. | 123/179 B |
| 4,192,279 | 3/1980 | Maisch et al. | 123/179 A |
| 4,231,345 | 11/1980 | Drews et al. | 123/179 B |
| 4,266,521 | 5/1981 | Nakano et al. | 123/179 L |
| 4,274,141 | 6/1981 | Tokuda et al. | 123/480 |

*Primary Examiner*—Charles J. Myhre
*Assistant Examiner*—Andrew M. Dolinar
*Attorney, Agent, or Firm*—Antonelli, Terry & Wands

[57] ABSTRACT

A method of starting the operation of an internal combustion engine utilizes a turning force transmitted from wheels of a vehicle through a clutch in addition to a driving force generated by a starting motor. A computer for controlling engine operations detects the initiation of the engine starting operation on the basis of the rotating speed of the engine or intake air quantity and additionally detects the termination of the engine starting operation when the engine rotating speed or intake air quantity exceeds an associated reference value. When the engine stops in the course of running of a vehicle, the engine can be re-started under the influence of the inertial force of the vehicle without resorting to the operation of the starting motor.

26 Claims, 12 Drawing Figures

METHOD FOR STARTING THE OPERATION OF AN INTERNAL COMBUSTION ENGINE

FIELD OF THE INVENTION

The present invention relates to a method of controlling an internal combustion engine with the aid of an electronic computer. In particular, the invention concerns a method of starting the operation of an internal combustion engine.

BACKGROUND OF THE INVENTION

In an internal combustion engine (hereinafter also referred to as a combustion engine or simply as an engine), heat energy released as the result of the combustion of fuel is converted into mechanical energy. The engine is provided with control means for controlling the energy conversion and an engine output shaft is caused to be rotated by the mechanical energy resulting from the energy conversion. It is possible to vary the torque derived from the rotation of the engine shaft by correspondingly varying the conditions under which the energy conversion takes place. Recently, there have attempts to effect optimum control of the energy converting conditions with the aid of an electronic computer. The control of the energy converting conditions, i.e. the conditions under which heat energy is converted into mechanical energy, is now one of the important controls for the operation of an internal combustion engine. In addition, it is important to carry out such control until energy conversion has been performed in a normal state in a combustion engine.

For starting the operation of a combustion engine, a starting (or starter) motor is first turned on to thereby rotate the engine shaft in order to cause energy conversion to take place. As is well known in the art, the conventional method of starting the engine operation involves the disengagement of the clutch and subsequently the engine is rotated by means of the starting motor, while the fuel supply to the engine as well as the ignition timing are controlled so as to be suited to the engine starting conditions.

However, when the driving of the engine shaft for starting the running of the engine is performed by resorting to only the starting motor, there may then arise the case where the engine operation can not be started due to possible failure of the starting motor or consumption of a power supply battery. Further, in the case in which the engine operation is abruptly stopped in the course of the running of a motor vehicle, it is conceivable to continue the running of the vehicle without stopping by re-starting the engine operation by making use of inertial energy of the vehicle. In other words, it is necessary to take into consideration the starting of the engine operation by applying to the engine shaft a rotating force available from the vehicle wheels in the control of the engine starting operation. In this connection, there has been yet no proposal as to the method of starting the engine operation by rotating the engine shaft by making use of torque or inertial energy available from the vehicle wheels in the hitherto known energy conversion control system which incorporates therein electronic circuits such as an electronic computer and the like.

SUMMARY OF THE INVENTION

Accordingly, an object of the invention is to provide a method of starting the internal combustion engine of a vehicle by utilizing mechanical energy or torque available from wheels of the vehicle.

In view of the above and other objects which will become apparent as the description proceeds, there is proposed, according to a feature of the invention, a method of starting the operation of an internal combustion engine, wherein torque available from wheels of the vehicle is transmitted to the engine shaft for rotation thereof through an engaged clutch. A decision is made as to whether the engine is in the starting state by checking at least one of the rotating speed of the engine shaft and the quantity of intake air. On the basis of the result of the decision, control signals appropriate to the instant starting conditions of the engine are supplied to control means for controlling the engine operation. Additionally, completed starting operation of the engine is determined on the basis of at least either the rotating speed of the engine shaft or the intake air quantity. Control is then transferred to a normal engine control mode, when it is determined that the engine starting operation has been completed.

In a preferred embodiment of the invention, a control circuit which is provided for controlling various engine operating states is set to a monitor mode in response to a transistory interruption of the energy converting operation taking place in the engine, for monitoring or detecting if the engine is in the state of being started again. When the engine operation begins to be restored under the influence of torque transmitted from the wheels of the vehicle through the engaged clutch, the control circuit detects the starting conditions of the engine on the basis of the information of at least one of the rotating speed of the engine shaft and the intake air quantity, whereby the fuel supply as well as the ignition timing is so controlled that the starting operation of the engine is effected in a desirably coordinated manner.

The control circuit additionally serves to monitor and detect completion of the engine starting process, whereupon the function of the control circuit is transferred to the control mode for controlling the normal energy converting operation of the engine. More particularly, the control circuit is then changed over to the state for controlling the mechanical energy output from the engine shaft in dependence on the load conditions thereof.

The above and other objects, features and advantages of the invention will be more readily understood from the description of the preferred embodiments of the invention.

DETAILED DESCRIPTION

Figure 1:
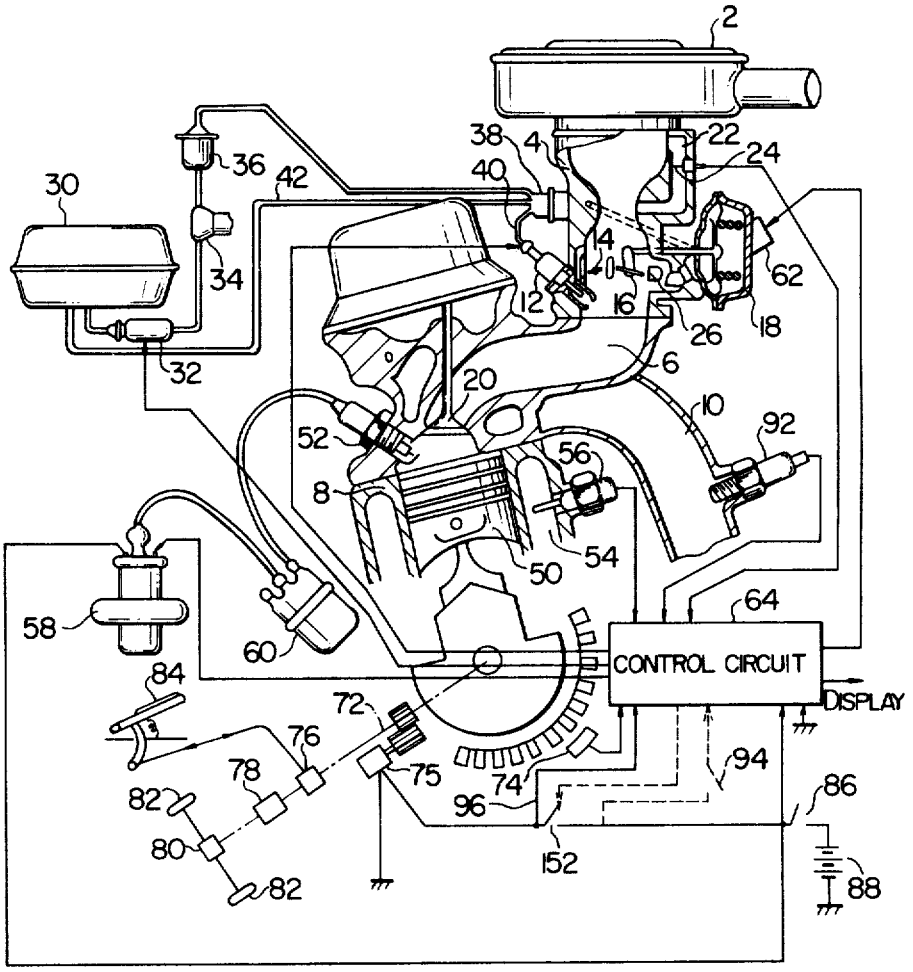
FIG. 1 shows schematically the arrangement of an internal combustion engine system.

Now, the invention will be described by referring to the drawings. Before entering into detailed description of the invention, various prior patent applications which have been assigned to the same assignee as the present application and which contain matters relevant to the preferred embodiment of the invention will be cited for reference in the following table.

TABLE 1

Figure 2:
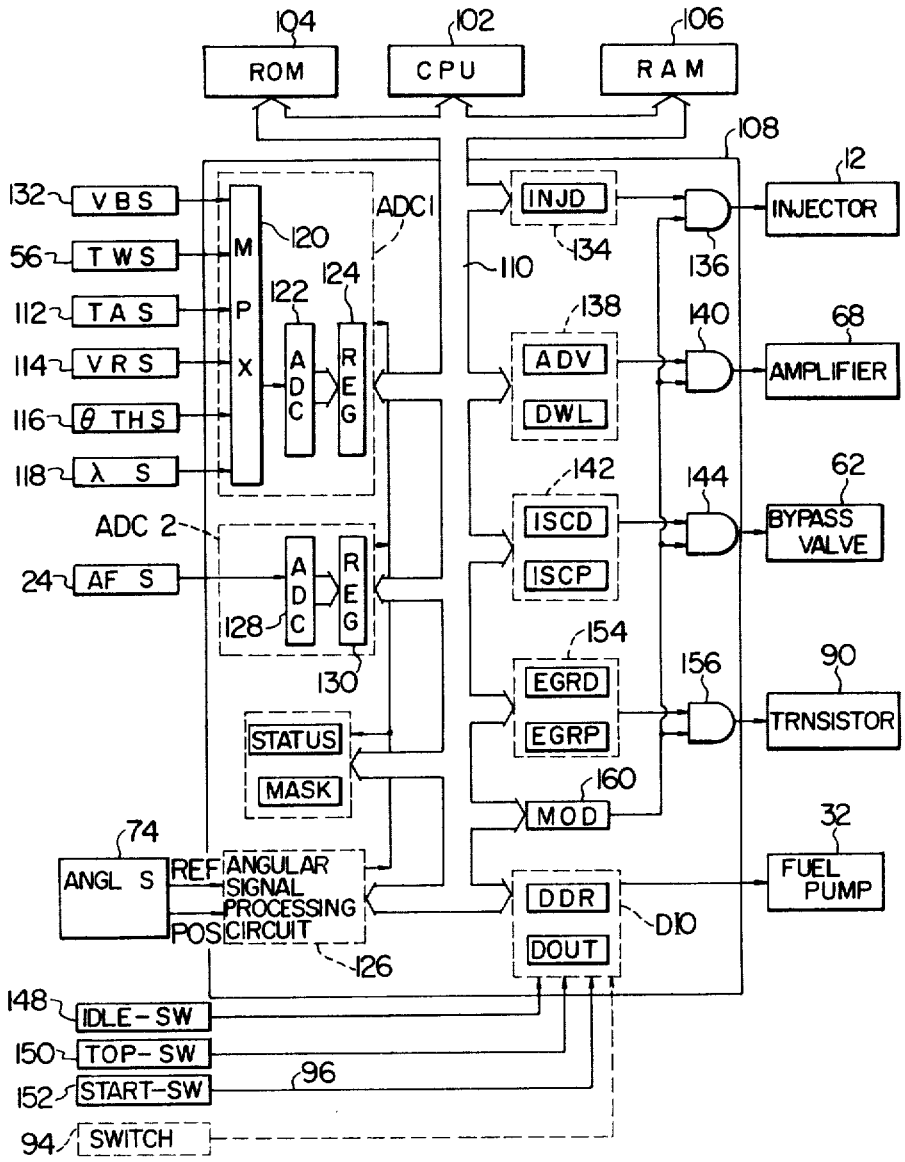
FIG. 2 is a block diagram for illustrating functionally the arrangement of a computer control system for controlling the operations of the engine system shown in FIG. 1.
Figure 3:
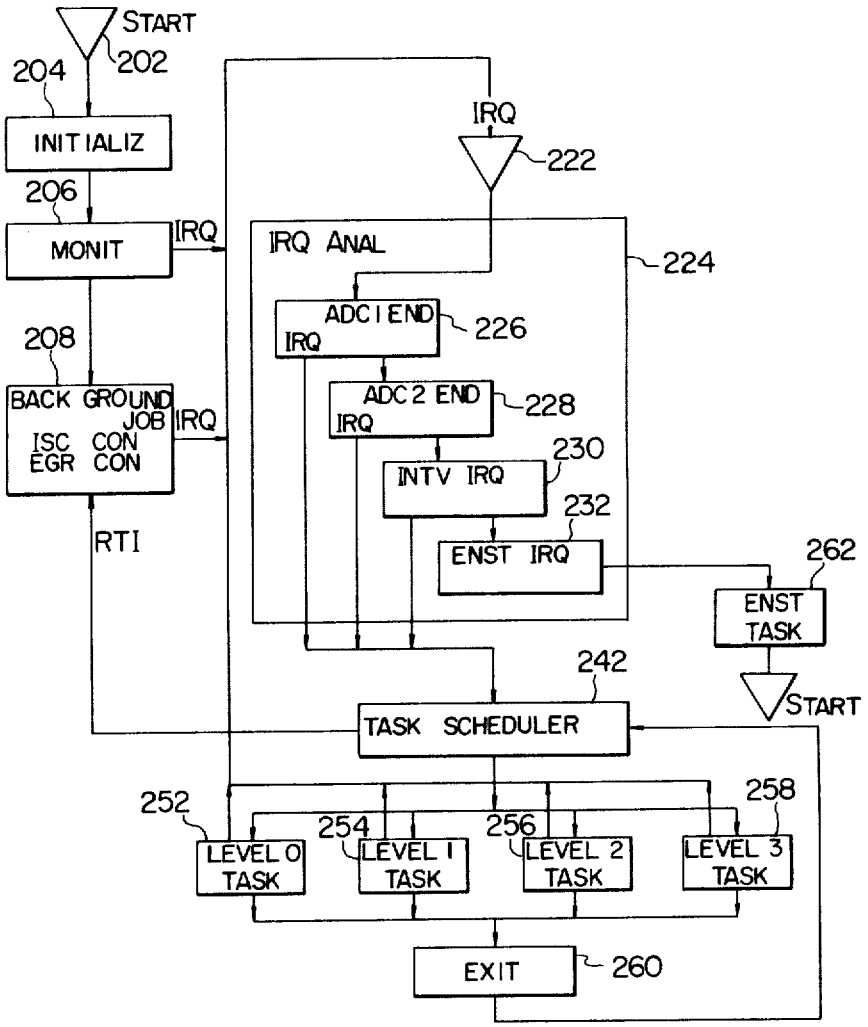
FIG. 3 is a flow chart for illustrating generally operations of the control system of FIG. 2.

| No. | Patent Application Nos. in Japan Corresponding Laid-Open Nos. | Date of Appln. in USA Ser. Nos./ U.S. Pat. Nos. | Relations to the Preferred Embodiment of the Invention |
|---|---|---|---|
| 1 | 114048/1977<br>47014/1977 | Sept. 20, 1978<br>943,930;<br>4,276,601 | I/O LSI 108 in FIG. 2 is disclosed in detail. |
| 2 | 125973/1977<br>58115/1979 | Oct. 18, 1978<br>952,531;<br>4,312,038 | Details of INTIALIZ program 204 and ENST program 262 in FIG. 3 are disclosed. |
| 3 | 125979/1977<br>58120/1979 | Oct. 18, 1978<br>952,532;<br>4,274,141 | INITIALIZ program 204 in FIG. 3 is shown in detail in a flow chart. |
| 4 | 14101/1978<br>108133/1979 | Feb. 13, 1979<br>011,845;<br>4,3310,888 | Flow chart relevant to MONIT program 206 in FIG. 3 is disclosed. |
| 5 | 125978/1977<br>58119/1979 | Oct. 18, 1978<br>952,275;<br>4,280,189 | Intake-air fetching program (a part of LEVEL-0 program in FIG. 3) is shown. |
| 6 | 90432/1978<br>17674/1980 | July 26, 1979<br>060,751;<br>4,296,721 | Arithmetic determination of fuel injection quantity in programs LEVEL-0 to LEVEL-3 in FIG. 3 is described. |
| 7 | 95482/1978<br>22163/1980 | Aug. 7, 1979<br>064,431;<br>4,275,142 | Method of detecting rotation speed of engine shaft in LEVEL-0 program is described. |
| 8 | 17329/1979 | Feb. 14, 1980<br>121,476;<br>4,298,941 | Flow chart is shown to illustrate subprograms IGNCAL and DWLCAL of LEVEL-0 program in FIG. 3. |
| 9 | 40901/1979 | April 4, 1980<br>137,519;<br>4,337,513 | Details of I/O LSI 108 in FIG. 2 and flow charts of IRQ ANAL 224, TASK SCHEDULER 242, EXIT 260, LEVEL-0-3 in FIG. 3 are described. |

Referring to FIG. 1 which shows a control apparatus for the overall system of a fuel injection type internal combustion engine, suction air is supplied to engine cylinders 8 from an air cleaner 2 through a throttle chamber and an air intake conduit or manifold 6. Combustion product gas is exhausted to the atmosphere from the cylinders 8 through an exhaust conduit 10.

There is provided in the throttle chamber 4 an injector 12 for fuel injection. The fuel injected from the injector 12 is atomized in an air passage provided within the throttle chamber 4 and mixed with air to thereby form a fuel-air mixture which is then supplied to combustion chambers of the engine cylinders 8 through the intake manifold 6 and associated air suction valves 20.

Throttle valves 14 and 16 are provided in the vicinity of the outlet orifice of the injector 12 at the upstream side thereof. The throttle valve 14 is mechanically interlocked with an acceleration pedal so as to be operated by a driver. On the other hand, the throttle valve 16 is arranged to be controlled by a diaphragm chamber 18 in such a manner that the valve 16 is fully closed in a range of a small air flow, while the throttle valve 16 is increasingly opened as a function of a negative pressure in the diaphragm chamber 18 which pressure in turn is increased as the air flow is increased, thereby to prevent resistance to the air flow from being increased.

A bypass air passage 22 is disposed in the throttle chamber 4 upstream of the throttle valves 14 and 16. An electric heater element or hot wire 24 constituting a part of a thermal type air flow meter is disposed in the air passage 22. Derived from the thermal type air flow meter is an electric signal which varies in dependence on the air flow speed and the thermal conductivity of the heater element 24. Because it is disposed in the bypass passage 22, the hot wire element 24 is protected from the adverse influence of a high temperature gas produced upon occurrence of back-fire in the cylinders 8 as well as from contamination due to dust carried by the suction air flow. The outlet of the bypass air passage 22 is located in the vicinity of the narrowest portion of a Venturi structure, while the inlet port of the bypass passage 22 is opened in the throttle chamber upstream of the Venturi.

The fuel is supplied to the fuel injector 12 from a fuel tank 30 through a fuel pump 32, a fuel damper 34, a filter 36 and a fuel pressure regulator 38. The fuel pressure regulator 38 serves to control the pressure of fuel supplied therefrom to the injector 12 through a pipe 40, so that the difference between the pressure of fuel supplied to the injector 12 and the pressure prevailing in the suction manifold 6 into which the fuel is injected is maintained at a predetermined value. Reference numeral 42 denotes a feed-back pipe through which excess fuel is returned to the fuel tank 30 from the fuel pressure regulator 38.

The fuel-air mixture sucked or drawn in through the suction valve 20 is compressed by a piston 50 within the cylinder and undergoes combustion as it is ignited by a spark produced at a spark plug 52. The cylinder 8 is cooled by cooling water the temperature of which is measured by a water temperature sensor 56. The output quantity from the sensor 56 is utilized as a control parameter representing the temperature of the engine. The spark plug 52 is supplied with a high voltage pulse from an ignition coil 58 through a distributer 60 in a proper ignition timing.

An engine shaft (crankshaft) 72 is provided with a crank angle sensor 74 which serves to produce a pulse signal REF representative of a reference crank angular position and a position pulse signal POS for every predetermined angle (e.g. 1°) of rotation of the crank shaft. In order that the engine shaft 72 is supplied with rotation torque, the shaft 72 is mechanically coupled to a starting motor 75 and to rear wheels 82 of the motor vehicle by way of a clutch 76, a transmission 78 and an universal joint 80. The clutch 76 is adapted to disengage the transmission 78 from the engine shaft by a clutch pedal 84.

The electrical signals output from the crank angle sensor, the water temperature sensor 56 and the thermal type air flow sensor 24 are applied to the input of a control circuit 64 which is constituted by a microcomputer and an associated circuit to be arithmetically processed, whereby the injector 12 and the ignition coil 58 are driven by the signals derived from the output of the control circuit 64.

Further disposed in the throttle chamber 4 is a bypass passage 26 communicating with the intake manifold 6 across the throttle valve 16, and a bypass valve 62 adapted to be opened or closed under control is disposed in the bypass passage 26.

The bypass valve 62 disposed in the bypass passage 26 across the throttle valve 16 is so controlled as to vary the flow section area of the bypass passage 26 in accordance with the lift of the valve 62 which is controlled by a pulse current output from the control circuit 64. To this end, the control circuit 64 produces a duty pulse signal for controlling the valve driving system, i.e. control means which in turn adjusts the lift or stroke thereof in accordance with the duty pulse signal.

Further, control means for the injector 12 and the ignition coil 58 are supplied with the pulse signal. Although it is not shown in FIG. 1, an exhaust gas recirculating valve (hereinafter referred to simply as EGR valve) is disposed between the intake conduit 6 and the exhaust gas conduit 10 and serves to introduce the exhaust gas into the intake conduit 6 from the exhaust gas conduit 10 in a quantity determined by the opening degree of the EGR valve which in turn is determined by the duty ratio of the pulse signal. Additionally, the control circuit 64 serves to control the fuel pump 32 and a display system including lamps.

The control circuit 64 is connected to a battery 88 through a key switch 86.

The starting motor 75 is driven when the driver or operator turns on a switch 152. The signal representative of the operating state of the starting motor is obtained through a line 96. Alternatively, a switch 94 adapted to be turned on or off by the driver may be provided with the output signal therefrom being supplied to the control circuit 64 for controlling the operation of the starter switch 152.

FIG. 2 shows in a schematic diagram a general arrangement of the overall control system. The control system includes a central processing unit (hereinafter referred to as CPU) 102, a read-only memory (hereinafter referred to as ROM) 104, a random access memory (hereinafter referred to as RAM) 106, and an input/output interface circuit 108. The CPU 102 performs arithmetic operations for input data from the input/output circuit 108 in accordance with various programs stored in ROM 104 and feeds the results of arithmetic operations back to the input/output circuit 108. Temporal data storage as required for executing the arithmetic operations is accomplished by using the RAM 106. Various data transfers or exchanges among the CPU 102, ROM 104, RAM 106 and the input/output circuit 108 are realized through a bus line 110 composed of a data bus, a control bus and an address bus.

The input/output interface circuit 108 includes input means constituted by a first analog-to-digital converter (hereinafter referred to as ADC1), a second analog-to-digital converter (hereinafter referred to as ADC2), an angular signal processing circuit 126 including a counter for counting the number of revolutions (revolution number) of the engine shaft, and a discrete input/output circuit (hereinafter referred to as DIO) for inputting or outputting single-bit information.

The ADC1 122 includes a multiplexer 162 (hereinafter referred to as MPX) which has input terminals applied with output signals from a battery voltage detecting sensor 132 (hereinafter referred to as VBS), a sensor 56 for detecting the temperature of cooling water (hereinafter referred to as TWS), an ambient temperature sensor 112 (hereinafter referred to as TAS), a regulated-voltage generator 114 (hereinafter referred to as VRS), a sensor 116 for detecting a throttle angle (hereinafter after referred to as $\theta$THS) and a $\lambda$-sensor 118 (hereinafter referred to as $\lambda$S). The multiplexer or MPX 120 selects one of the input signals to supply it to an analog-to-digital converter circuit 122 (hereinafter referred to as ADC). A digital signal output from the ADC 122 is stored by a register 124 (hereinafter referred to as REG).

The analog output signal from the air flow sensor denoted herein by 24 (hereinafter referred to as AFS) is supplied to the ADC2 to be converted into a corresponding digital quantity through an analog-to-digital converter circuit 128 (hereinafter referred to as ADC) and set in a register 130 (hereinafter referred to as REG).

An angle sensor 146 (hereinafter termed ANGS) is adapted to produce a signal representative of a standard or reference crank angle, e.g. of 180° (this signal will be hereinafter termed REF signal) and a signal representative of a minute crank angle (e.g. 1°) which signal will be hereinafter referred to as POS signal. Both of the signals REF and POS are applied to the angular signal processing circuit 126 to be shaped. The signals POS are counted for a predetermined time for detecting the engine rotation speed in the circuit 126.

The discrete input/output circuit or DIO has inputs connected to an idle switch 148 (hereinafter referred to as IDLE-SW), a top-gear switch 150 (hereinafter termed TOP-SW) and a starter switch 152 (hereinafter referred to as START-SW).

Next, description will be presented of the control operation and objects to be controlled by the pulse output circuit in dependence on the results of arithmetic operations of CPU. An injector control circuit 134 (hereinafter referred to as INJC) functions to convert the digital value representing the results of the arithmetic operation into a corresponding pulse signal. More specifically, a pulse signal having a pulse duration or width corresponding to a quantity of fuel to be injected is produced by the INJC 134 and applied to an injector denoted herein by 12 through an AND gate 136.

An ignition pulse generator circuit 138 (hereinafter referred to as IGNC) comprises a register for setting therein an ignition timing (hereinafter referred to as ADV) and a register (hereinafter referred to as DWL) for setting therein a time point for the current flow through a primary winding of the ignition coil. These data placed in the registers ADV and DWL are supplied from the CPU 102. The pulse signal produced on the basis of the data placed in these registers are supplied through an AND gate 140 and an amplifier 68 to the ignition coil 58.

The opening degree of the bypass valve denoted herein by 62 is controlled by a pulse signal supplied thereto from an ignition control circuit 142 (hereinafter referred to as ISCC) through an AND gate 144. To this end, the ignition control circuit ISCC 142 is composed of a register ISCD for setting therein the pulse width of the pulse signal and a register ISCP for setting therein a pulse repetition rate or period of the pulse signal.

The EGR control pulse generator circuit 154 (hereinafter referred to as EGRC) for controlling a transistor 90 which in turn controls the EGR control valve is composed of a register EGRD for setting therein a value representative of the duty cycle of the pulse signal applied to the transistor 90 and a register EGRP for setting therein a value representative of the pulse repetition period of the same pulse signal. The output pulse from the EGRC is applied to the transistor 90 through an AND gate 156.

The single-bit input/output signals are controlled by the circuit DIO. The input signals include the IDLE-SW signal, TOP-SW signal and the START-SW signal described hereinbefore. The output signal includes a pulse output signal for driving the fuel pump 32. The DIO is provided with a register DDR for determining whether the terminal thereof is to be used as the input terminal or the output terminal, and a register DOUT for holding the output data.

A mode register 160 (hereinafter referred to as MOD) functions to hold instructions for commanding the various inner states of the input/output circuit 108. For example, in accordance with the command set in this MOD register 160, all AND gates 136, 140, 144 and 156 are controlled with respect to enabling and disenabling conditions. Further, by setting and resetting a go signal in the MOD register 160, initiation as well as termination of the output signals from INJC, IGNC and ISCC can be controlled respectively.

The detailed circuit configuration of the I/O LSI 108 is shown in the above-described U.S. patent application Ser. Nos. 943,930; 952,279; 952,276 and so on.

FIG. 3 illustrates a program system for the control circuit shown in FIG. 2. When a power supply source is turned on by the key switch 86 shown in FIG. 1, the CPU 102 is set in a start mode to execute an initialization program 204 (INITIALIZ). Subsequently, a monitor program (MONIT) 206 is executed, which is followed by the execution of a background job (BACKGROUND JOB) 208. The background jobs include, for example, a task for calculating the quantity of EGR (hereinafter referred to as EGR CON. task) and a task for calculating the control quantities for the bypass valve 62 (hereinafter referred to as ISC CON). When an interrupt request (hereinafter termed IRQ) makes its appearance during the execution of these tasks, an IRQ analyzing program 224 (hereinafter termed IRQ ANAL) is executed from the start step 222. The program IRQ ANAL is constituted by an end interrupt processing program 226 for the ADC1 (hereinafter referred to as ADC1 END IRQ), an end interrupt processing program 228 and for the ADC2 (hereinafter referred to as ADC2 END IRQ) and an interval interrupt processing program 230 (hereinafter referred to as INTV IRQ), and an engine stop interrupt processing program 232 (hereinafter referred to as ENST IRQ) and issues activation requests (hereinafter referred to as QUEUE) to the tasks to be activated among those.

The tasks to which the request QUEUE is issued from the subprograms ADC1 END IRQ 226, ADC2 END IRQ 228 and INTV IRQ 230 of the program IRQ ANAL 224 are a task group 252 of level "0", a task group 254 of level "1", a task group 256 of level "2" or a task group 258 of level "3" or alternatively given individual tasks which constitute parts of these task groups. The task to which the request QUEUE is issued from the program ENST IRQ 232 is a task program 262 for processing the stopping of the engine (this task will be hereinafter referred to as ENST TASK). When the task program ENST TASK 262 has been executed, the control program is set back to the start mode and the start step 202 is reaquired.

A task scheduler 242 serves to determine the sequence in which the task groups are executed such that the task groups to which the request QUEUE is issued or execution of which is interrupted are executed starting from the task group of the highest level. In the case of the illustrated example, it is assumed that the level "0" is the highest level. Upon completed execution of the task group of highest level, a termination indicating program 260 (hereinafter referred to an EXIT) is executed to inform this fact to the task scheduler 242. Subsequently, the task group of the next highest level among those in QUEUE is executed and so forth.

When there remains no task group the execution of which is interrupted or to which the request QUEUE is issued, the execution of the background jobs 208 is regained under the command of the task scheduler 242. Further, when IRQ is issued during execution of the task group among those of level "0" to "3", the starting step 222 of the IRQ processing program is reaquired.

The IRQ ANAL program 224 is described in detail in FIG. 13 of U.S. Application Ser. No. 137,519. The TASK SCHEDULER program 242 and EXIT program 260 are also shown in detail in FIGS. 14 and 16 of U.S. Application Ser. No. 137,519 respectively.

Initiations and functions of the individual task programs are listed in Table 2.

TABLE 2

| Level | Identification of programs | Functions | Activation (Timing) |
|---|---|---|---|
| — | IRQ ANAL | Analysis of IRQ and issue of requests for activating task groups or tasks | IRQ |
| — | TASK SCHEDULER | Determination of task groups or tasks to be executed | End of IRQ ANAL or end of EXIT |
| — | EXIT | Informing of ended executions of task groups | End of individual task groups |
| 0 | AD1IN | Fetching of output from ADC1 | INTV IRQ (10m · sec) or ADC1END |
| | AD1ST | Initiation of ADC1 | INTV IRQ (10m · sec) |
| | AD2IN | Fetching of output from ADC2 | INTV IRQ (10m · sec) or ADC1 END |
| | AD2ST | Initiation of ADC2 | INTV IRQ (10m · sec) |
| | RPMIN | Fetching of engine speed | INTV IRQ (10m · sec) |
| 1 | INJC | Calculation of fuel injection quantity | INTV IRQ (20m · sec) |
| | IGNCAL | Calculation of ignition timing | INTV IRQ (20m · sec) |

TABLE 2-continued

| Level | Identification of programs | Functions | Activation (Timing) |
|---|---|---|---|
| | DWLCAL | Calculation of duration of primary current through ignition coil | INTV IRQ (20m · sec) |
| 2 | LAMBDA | Control of λ | INTV IRQ (40m · sec) |
| 3 | HOSEI | Calculation of corrections | INTV IRQ (100m · sec) |
| — | ISC CON | Calculation of opening degree of bypass valve 62 | BACKGROUND JOB |
| — | EGRCON | Calculation of opening degree of negative-pressure-controlled valve for EGR | BACKGROUND JOB |
| — | INTLIZ | Setting initial values at input/output circuit | START or RE-START |
| — | MONIT | Monitoring of START-SW and starting of fuel pump | START or RE-START |
| — | ENST TASK | Stop of fuel pump and resetting of IGN | ENST IRQ |

As can be seen from the above Table 2, there are programs for monitoring or supervising the control system illustrated in FIG. 3 such as programs IRQ ANAL, TASK, SCHEDULER and EXIT. These programs are stored in ROM 104 at addresses A000 to A2FF, as is illustrated in FIG. 4.

As the program of level "0", there are AD1ST, AD2IN, AD2ST and RPMIN which are activated usually by INTV IRQ produced for every 10 m.sec. Programs of level "1" include CARBC, IGNCAL and DWLCAL programs which are activated for every INTV IRQ produced periodically at time interval of 20 m.sec. As the program of level "2", there is LAMBDA which is activated by INTV IRQ for every 40 m.sec. The program of level "3" is HOSEI which is activated by INTV IRQ for every 100 m.sec. The programs EGRCON and ISCON are for the background jobs. The programs of level "0" are stored in ROM 104 at addresses A600 to AAFF as PROG1, as is shown in FIG. 4. The level "1" programs are stored in ROM 104 at addresses AB00 to ADFF as PROG2. The level "2" programs are stored in ROM 104 at addresses AE00 to AEFF as PROG3. The program of level "3" is stored in ROM 104 at addresses AF00 to B0FF as PROG4. The program for the background jobs is held at B000 to B1FF as PROG5. A list (hereinafter referred to as TSA) of the start addresses of the programs PROG1 to PROG4 described above is stored at addresses B200 to B2FF, while values representative of the activation periods of the individual programs (hereinafter referred to as TTM) are stored at addresses B300 to B3FF.

Figure 4:
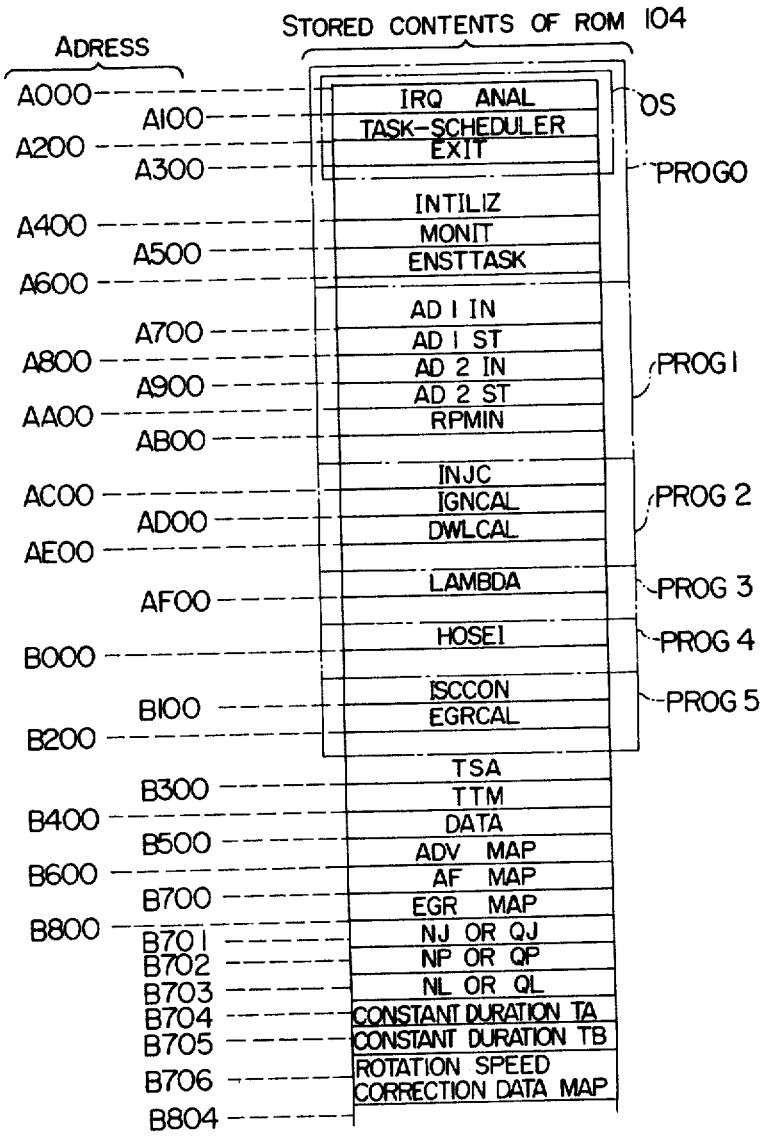
FIG. 4 shows an arrangement of a memory used in the control system of FIG. 2.

Other data as required are stored in ROM 104 at addresses B400 to B4FF, as illustrated in FIG. 4. In succession thereto, data ADV MAP, AF MAP and EGR MAP are stored at B500 to B7FF.

The program INITIALIZ shown at 204 in FIG. 3 will be described in detail by referring to FIG. 5. At a step 282, a standby arear is set upon issuing of IRQ. Next, at a step 284, RAM 106 is cleared. At a step 286, the registers of the input/output circuit 108 are initialized (i.e. loaded with initial values). This initialization step includes stetting of the number of engine cylinders, initial value of the angle sensor, setting of DDR of DIO, setting of a timer for issuing INTV IRQ, setting of detection period for issuing of ENST IRQ, and setting of measuring time for detecting the revolution number of the engine.

At a step 288, a ADC1 is triggered, while the inhibition of END IRQ for ADC1 is removed. In this case, a jump is made to a address A700 shown in FIG. 4 which is the start address of the program AD1ST. As the consequence, the output signal from VBS (battery voltage detecting sensor) 132 which constitutes one of the inputs to MPX 120 of the ADC1 shown in FIG. 2 is selected and applied to the input of the ADC 122. At a step 290, the issue of END IRQ for ADC 122 is awaited. When the digital value output from ADC 122 upon completed operation thereof is loaded into REG 124, the termination of the operation of ADC 122 is coupled to the status register STATUS and ADC1 END IRQ is transferred to CPU 102. As a consequence, the program AD1 IN is executed, whereby the output from the battery voltage detecting sensor 132 is fetched or sampled.

At a step 292, it is ascertained whether all the output values from the sensors 132 to 118 have been fetched. Since only the fetching of the output signal from the sensor 132 has been completed in this case, the routine is returned to the step 288, at which the program AD1ST is again started, whereby MPX 120 selects the output from the sensor 56 as the next input thereto. Upon completion of the analog-to-digital conversion of the output signal from the sensor 56, the program AD1IN (fetching) is executed at a step 292, whereby the digital value representative of the output from TWS (temperature sensor for cooling water) 56 stored in the register or REG 124 is read out and stored in an area DATA in ROM 104. At the step 292, the routine returns to the step 288. In this manner, through repetitive execution of the steps 288 to 292 in a looped fashion, the digital values representing the outputs from the sensors 132 to 118, respectively, are successively fetched. When the output value of the λ-sensor 118 has been fetched, the program proceeds to a step 294.

Figure 6:
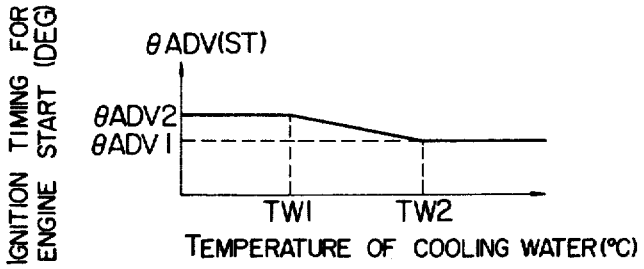
FIG. 6 graphically illustrates the ignition timing for an engine starting operation.

At the step 294, the ignition timing for starting the engine is arithmetically determined. To this end, the ignition timing θADV(ST) is arithmetically determined as a function of the temperature TW of engine cooling water. The relationship between the ignition timing for starting the engine and the cooling water temperature is graphically illustrated in FIG. 6. In accordance with the characteristic relationship illustrated in FIG. 6, the ignition timing ADV(ST) is arithmetically determined. The results as obtained are loaded in the register ADV of IGNC 138 shown in FIG. 2.

Figure 7:
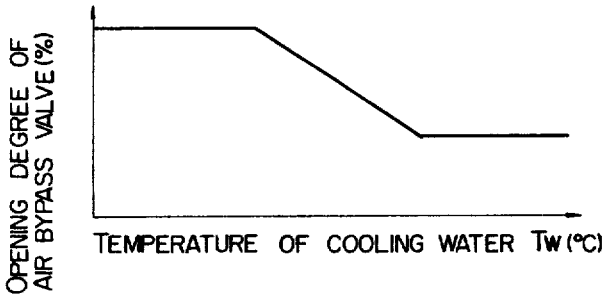
FIG. 7 graphically illustrates a bypass valve characteristic.

At a step 296, the opening degree of the air bypass valve 62 for starting the engine is arithmetically determined as a function of the temperature of cooling water, as is graphically illustrated in FIG. 7. The results of the executed arithmetic operation are placed in the register EGRD. A fixed value for the opening degree of the air solenoid valve is set at the register EGRP. In FIG. 7, the valve opening degree of the air bypass valve 62 for starting the engine is repeated along the ordinate in terms of ratio to the fixed value stored in EGRP.

Figure 8:
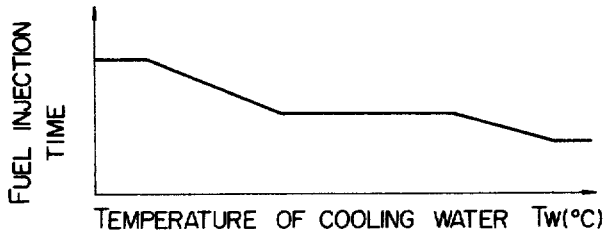
FIG. 8 graphically illustrates a fuel injection characteristic.

At a step 298, the initial value for fuel injection is arithmetically determined in accordance with the fuel injection characteristic shown in FIG. 8. The resulted value is placed in the register INJD.

Figure 9:
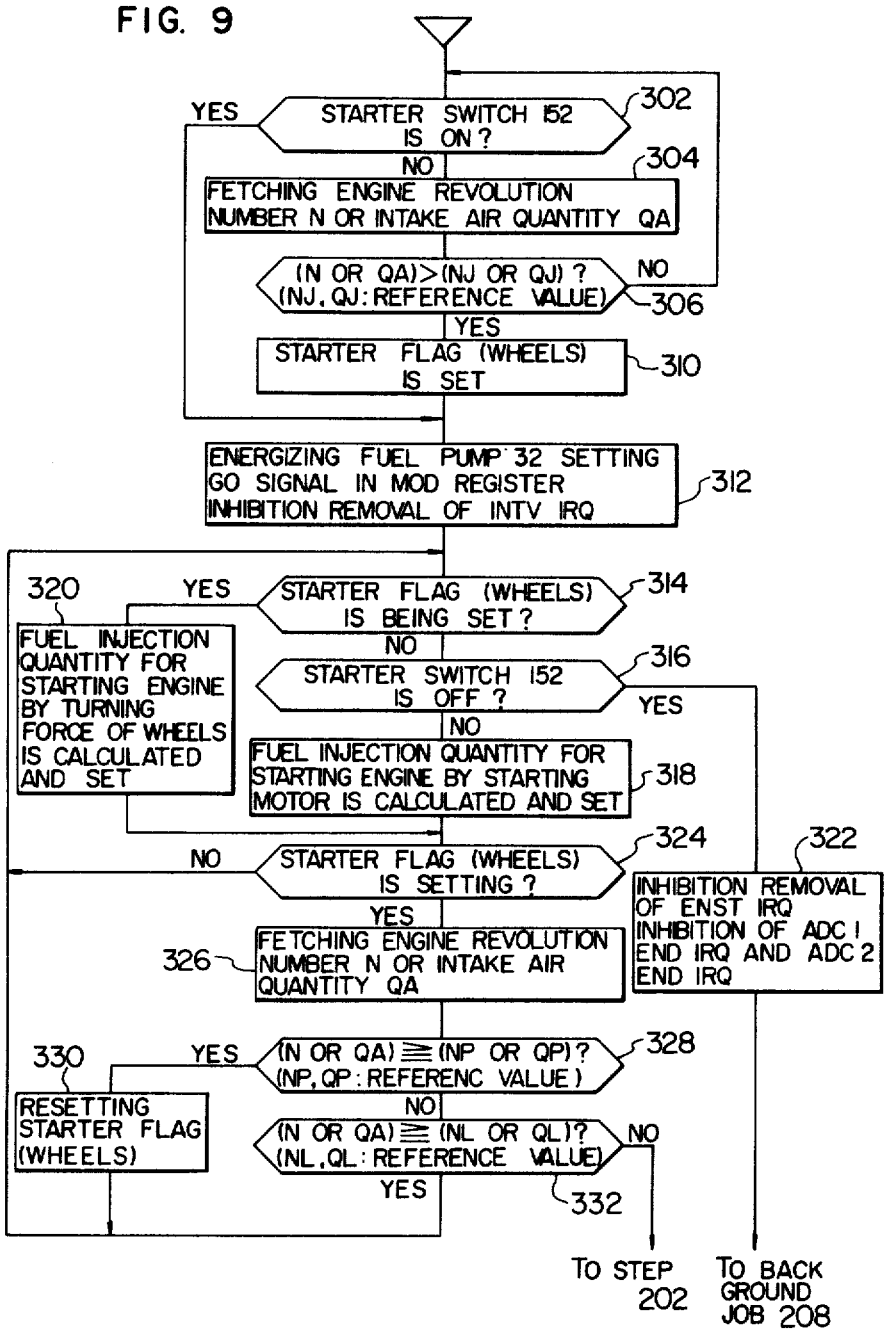
FIG. 9 is a flow chart to the illustrate details of a MONIT program (206) shown in FIG. 3.

Thus the execution of the INITIALIZ 204 shown in FIG. 3 has been completed, and now a MONIT program 206 shown in detail in FIG. 9 is executed in turn. It should be noted that the execution of the MONIT program 206 is a major process with which the invention is concerned.

The MONIT program has two principal functions, one of which is to detect the beginning of the engine starting operation, while the other is to detect the completed engine starting operation and thereby allow the engine operation to be shifted to the normal energy converting operation.

Referring to FIG. 9, the function as well as processing operations for detecting the beginning of the engine starting operation are executed at steps 302 to 312, while the function as well as processing operations for detecting the completed engine starting operation are executed at steps 314 to 332.

In the first place, the sub-program which includes the steps 302 to 312 for detecting the beginning of the engine starting operation and executing the associated processing operations will be described. As described hereinbefore, the method of starting the operation of engine can be effected in two different ways, i.e. through the operation of the starting motor on the one hand and through the utilization of inertial torque available from the vehicle wheels. Accordingly at the step 302, it is determined whether the starting operation is to be effected by torque produced by the starting motor 75. To this end, a determination is made as to whether the starting motor is driven or not by checking if the switch 152 is turned on. If so, a decision is made to the effect that the engine starting operation should begin. Then, the execution of the program proceeds to the step 312. On the other hand, when the switch 152 is off or opened, it is determined at the steps 304 and 306 that the engine starting operation should be effected by making use of the torque or turning force available from the wheels of the motor vehicle. To this end, the rotating speed N of the engine shaft or the intake air quantity QA is measured at the step 304 and the value as detected is placed in the RAM 106 at the address 00A0 or 00A1 shown in FIG. 10. The rotating speed N or the intake air quantity QA thus fetched is then compared with an associated reference value NJ or QJ. If the actually measured value of N or QA is larger than the relevant reference value NJ or QJ, it is determined that the engine starting operation has been initiated. The program then proceeds to the step 310. On the other hand, when the fetched value N or QA is smaller than the associated reference value NJ or QJ, it is determined that the engine starting operation is not yet initiated. The program will then return to the step 302.

Figure 10:
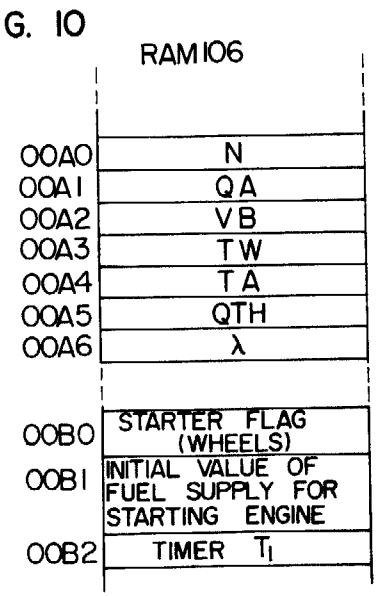
FIG. 10 shows in detail a storage pattern in a RAM shown in FIG. 2.

When it is determined at the step 306 that the measured value N or QA is greater than the respective reference value NJ or QJ, a starter flag "WHEELS" which represents that the starting operation is based on the inertial turning force derived from the wheels is set in the RAM 106 at the address 00B0 shown in FIG. 10 at the step 310. In order to supply a quantity of fuel for starting the engine operation, a signal of a logic level "1" for driving the fuel pump 32 is set at the DIO shown in FIG. 2. A typical circuit configuration of the DIO is shown in detail in FIGS. 24 and 31 of U.S. Patent Application Ser. No. 137,519 listed in TABLE 1. More specifically, logic level "H", that is a logical "1", is set at the zero-th bit of DDR shown in FIG. 31 of the U.S. Application mentioned just above, and additionally, logic level "H" (or a logical) "1" is set at the zero-th bit of DOUT to produce a logic level "H" or "1" from DIO. Subsequently, a logical "1" or "H" is set in the MOD register 160 to thereby send a drive output to the control means (12, 68, 62 and 90). As a consequence, AND gates 136, 140, 144 and 156 are enabled. Further, a logical "1" is set in the status register STATUS to thereby allow the generation of interrupt requests in timing with the pulses produced periodically at a predetermined time interval. A circuit arrangement to serve to these functions is shown in detail in FIG. 22 of the U.S. Patent Application Ser. No. 137,519 listed in TABLE 1. Under the conditions described above, the flip-flop 739 shown in FIG. 22 of the just mentioned application is set, resulting in that an interrupt request is issued periodically at a predetermined time interval, e.g. every 10 mSEC.

At steps 314 to 332, the quantity of fuel to be supplied to the engine for effecting the starting operation thereof is arithmetically determined and detection of the completed engine starting operation is made. At the steps 316 and 324, the engine starting operation based on the turning force produced by the starting motor is detected, while at steps 314, 316, 328 and 330, completion of the engine starting operation based on turning turque derived from the wheels is detected.

Since the flag "WHEELS" is not set at the address 00B0 shown in FIG. 10 in the case of the engine starting operation based on the turning force produced by the starting motor 75, this condition is detected at the step 314 and execution proceeds to the step 316 at which it is determined whether the starter switch 152 is opened or off. In the case of the engine starting operation based on the turning force generated by the starting motor, a decision as to whether the starting operation has come to an end is made on the basis of a command issued by the driver. More specifically, when the action is taken by the driver or operator to stop the driving of the starting motor, it is then determined that the engine has been successfully started and the program proceeds to the step 322. In this connection, when the starting motor is stopped by the driver not withstanding that the engine starting operation has not yet been completed, there is issued at the step 322 an ENST IRQ which is the interrupt request generated at a lower rotation speed of the engine shaft than a predetermined one. The program serving for this purpose is the ENST TASK 262 shown in FIG. 3. When the starting motor is being driven, the program being executed proceeds from the step 318 to the step 324 and hence to the step 314 again, because the flag "WHEELS" is not set in the RAM at the address 00B0. In this manner, a looped routine comprising the steps 314, 316, 318 and 324 is repeated until the starting motor has been stopped. As long as the looped routine is repeated, the interrupt INTV IRQ is issued every 10 mSEC. In response to the interrupt INTV IRQ, the IRQ ANAL 224 is executed starting from the entry 222 shown in FIG. 3. At the step 230, the content of a timer t1 at the address 00B2 of RAM 106 is read out and a one is added to the read out value and then it is set in the timer t1. The contents at the address 00B2 has been reset to zero at the step 284 shown in the flow chart of FIG. 5. Accordingly, the time elapsed after the start of the starting motor is progressively counted and held at the address 00B2 as a value $t_i$. On the other hand, the initial value of the fuel supply for the engine starting operation is arithmetically determined at a step 298 of the program illustrated in FIG. 5 and set at the address 00B1 of RAM. The quantity of fuel injection for the engine starting operation is calculated in accordance with the following expression:

$$\text{Quantity of Fuel Injection} = \text{Initial Value of Fuel Supply} \times \frac{TA - t_i}{TA}$$

where TA is a constant value and held at the address B704 of ROM shown in FIG. 4, while $t_i$ represents an accumulated value held at the address 00B2 shown in FIG. 10. As can be seen from the above expression, the quantity of the fuel injection is progressively decreased as a function of time. Of course, it is possible to delete this step simplify the control. In such a case, the fuel injection is made constant at the initial value. The value arithmetically determined in accordance with the expression cited above is set at INJD 134 shown in FIG. 2. By the way, the value for the ignition timing determined at the step 294 shown in FIG. 5 remains as set at the ADV register and DWL register, and is invariable independently of the elapse of time.

Next, description will be presented of the engine starting operation which is effected by making use of the turning force derived from the wheels. In this case, the flag "WHEELS" is set in RAM at the address 00B0. Consequently, execution of the program proceeds from the step 314 to the step 320, at which step the quantity of fuel injection appropriate to the engine starting operation based on the turning force derived from the wheel is calculated from the initial value for the fuel supply in accordance with the following expression:

$$\text{Quantity of Fuel Injection} = \text{Initial Value of Fuel Supply} \times \text{Rotating Speed Correcting Factor} \times \frac{TB - t_i}{TB}$$

From the above expression, the quantity of fuel injection for the engine starting operation based on the turning force derived from the wheels can be arithmetically determined. The initial value of the fuel supply has been determined at the step 298 shown in FIG. 5 and held in RAM at the address 00B1. The rotating speed correcting factor corresponds to a value which is read out from a data map contained at the address B 706 to B 804 of ROM shown in FIG. 4 in accordance with the rotating speed N, while TB is a fixed value read out from the ROM at the address B 705 and $t_i$ represents the accumulated value held at the address 00B2 of RAM as described hereinbefore. Thus, the fuel supply quantity is decreased as a function of time. However, when this step is deleted for simplifying the control process, the amount of fuel is injected is held constant at the initial value.

Since the flag "WHEELS" is set at the address 00B0 of the RAM, execution of the program proceeds from the step 324 to the step 326 at which step the engine rotating speed N or the intake air quantity QA is fetched and set at the address 00A0 or 00A1 of RAM. At the step 328, it is determined whether the value N or QA has reached the reference value NP or QP which represents the completion of the engine starting operation. The value of NP or QP is held at the address B 702 of ROM shown in FIG. 4. When the measured value N or QA exceeds the reference value NP or QP, it is determined that the engine starting operation has come to an end, whereby the flag "WHEELS" is reset at the step 330. Execution of the program may then proceed to the step 316 from the step 314. Since the starter switch 152 is opened or off in the case of the engine starting operation based on the turning force derived from the wheels, the step 322 is executed. In this manner, it is determined that the engine starting operation has been completed, when the flag "WHEELS" is reset at the step 330, whereby execution of the program may proceed to the step 322 by way of the steps 314 and 316.

On the other hand, when the measured value N or QA is still smaller than the respective reference value NP or QP for terminating the engine starting operation, execution of the program proceeds to the step 332, at which step it is determined whether the engine operation has reached substantially an engine stop operation. More specifically, when the measured value N or QA is found to be larger than the respective reference value NL or QL, it is determined that the starting operation is normally carried out, as a result of which the step 314 is reacquired. However, when the measured values N or QA is found to be still smaller than the respective reference value NL or QL, it is then determined that the engine is no longer in the starting operation mode, whereby a jump is made to the point 202 at which step the program is reset.

Figure 5:
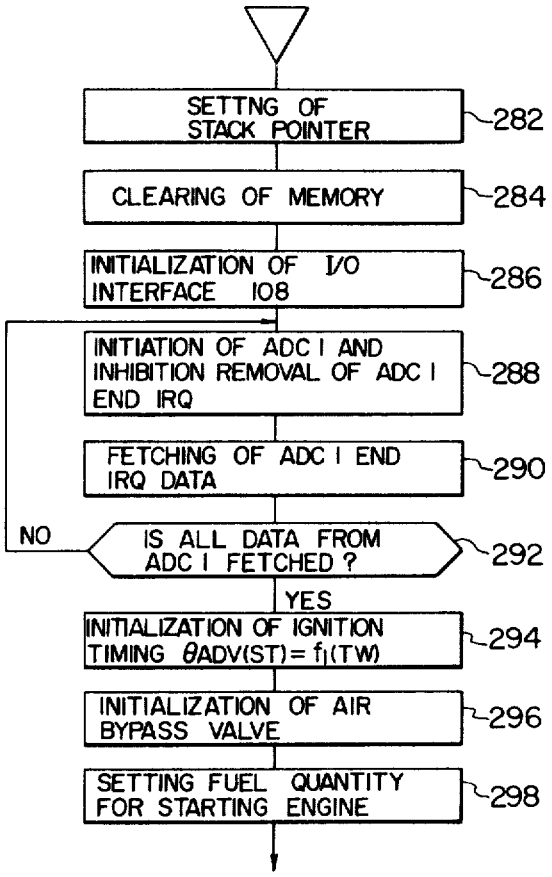
FIG. 5 is a flow chart to illustrate in detail an INITIALIZ program (204) shown in FIG. 3.

Subsequently, the INITIALIZ program 204 shown in FIG. 5 is executed. When I/O LSI is initialized at the step 286 of this program, the MOD register 160 is reset, resulting in that the AND gates 136, 140, 144 and 156 are returned to the disabled or blocked state.

In this manner, completion of the engine starting operation based on the turning force derived from the wheels and the starting motor can be detected through execution of the steps 314 to 332. When the engine starting operation has come to an end, the program proceeds from the step 316 to the step 322 where the inhibition of the ENST IRQ, which is the interrupt request issued upon stoppage of the normal energy converting operation of the engine, is no longer inhibited, while issuance of the interrupt request ADC1 END IRQ as well as ADC2 END IRQ is inhibited.

By the way, a typical circuit arrangement for issuing ENST IRQ and the processings processing operations effected for the ENST TASK 262 shown in FIG. 3 are described in detail in FIGS. 17 to 22 of U.S. Patent Application Ser. No. 952,531 listed in TABLE 1. Further, the operation at the step 322 is illustrated in FIGS. 8 and 22 of U.S. Patent Application Ser. No. 137,519 listed in TABLE 1.

Figure 11:
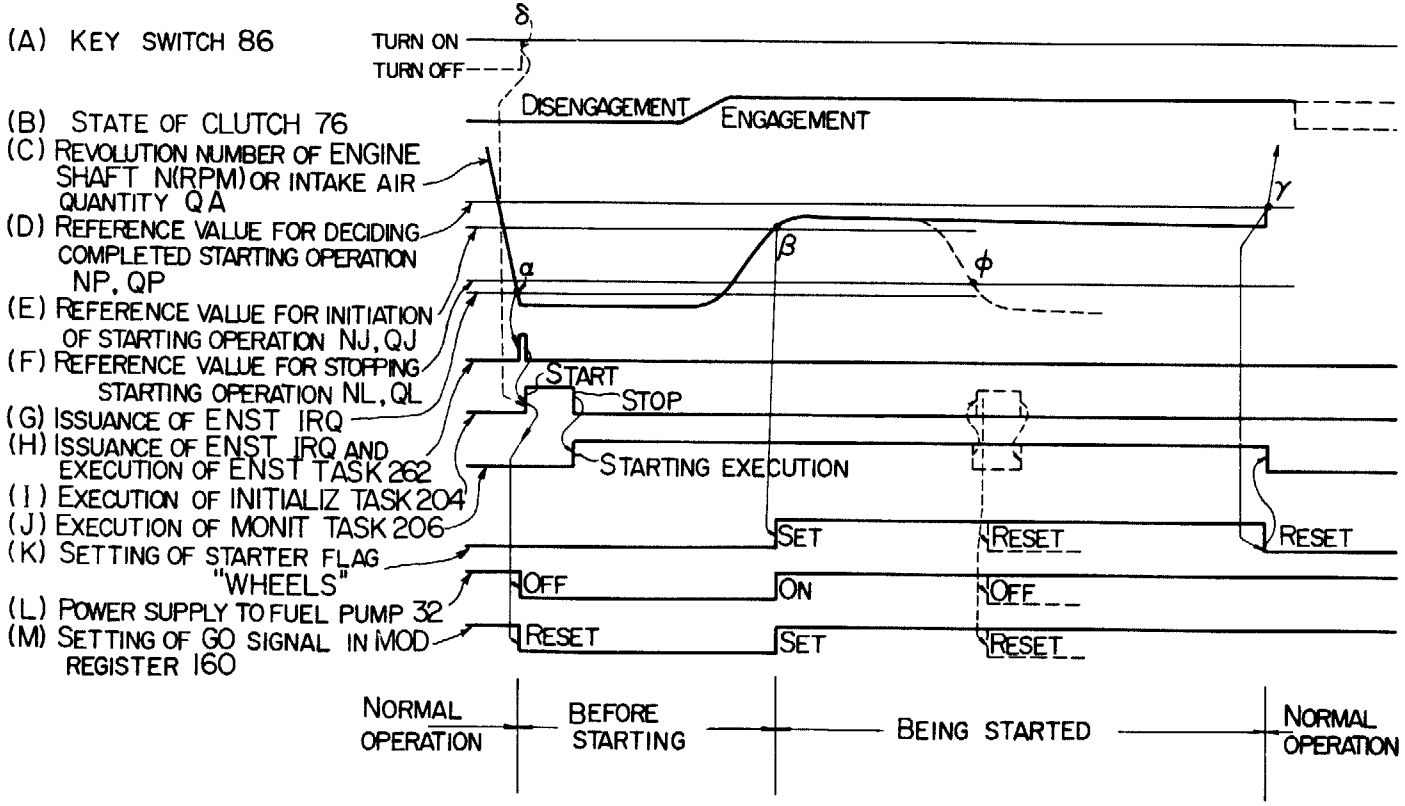
FIG. 11 shows a signal-timing diagram to illustrate execution of the MONIT program shown in FIG. 9.

Now, the operation illustrated in the flow chart of FIG. 9 will be described by referring to FIG. 11. It is assumed that the key switch 86 is turned on and the control circuit 64 described in conjunction with FIG. 2 is supplied with a power source voltage from a battery 88, as shown at (A) in FIG. 11. The rotating speed N (r.p.m) of the engine shaft or the intake air quantity QA is decreased as shown at (C). When the value N or QA is decreased below the level shown at (G), the energy conversion can no longer take place in the engine. From this time point represented by a point α, ENST IRQ is issued and ENST TASK 262 is executed, as shown at (H), resulting in the program being reset. Subsequently, INITIALIZ TASK 204 is executed, as shown at (I). As a result, the power supply to the fuel pump is turned off, as shown at (L) and (M), while the signal GO held in the MOD register 160 is reset. As a consequence, the AND gates 136, 140, 144 and 156 are disabled. Upon completed execution of the INITIALIZ TASK 204, execution of MONIT TASK 206 begins, as shown at (J). On the assumption that the vehicle is still moving even after the engine operation has been stopped, the wheels carry a torque of a magnitude sufficient for restarting the engine operation. Thus, when the clutch 76 is changed over to the engaged state from the idle state, the rotating speed N or the intake air quantity QA shown at (C) in FIG. 11 begins to increase. When the measured value N or QA increases beyond the level NJ or QJ shown at (E), as indicated at a point $\beta$, it is determined that the engine is in the state of being started under the influence of the turning force supplied from the wheels. The engine is now in the starting state. When the value N or QA shown at (C) increases further beyond the reference level NP or QP shown at (D), as indicated by a point $\gamma$, the flag "WHEELS" shown at (K) is reset, whereupon execution of MONIT TASK 206 shown at (J) is terminated. The engine is now in the normal operating state capable of performing the energy converting operation.

In the case where the key switch is closed from the opened or off-state as indicated by a point $\delta$ at (A), execution of the INITIALIZ TASK 204 is started, as illustrated at (I). When the engine starting operation does not take place in a satisfactory manner after the flag "WHEELS" has been set as shown at (K), resulting in the rotating speed N of the engine shaft or the intake air quantity QA being decreased below the reference level NL or QL, it is determined that the starting operation has ended in failure, whereupon execution of the INITIALIZ TASK 204 is again started as indicated by a dotted line at (I). Then, the flag "WHEELS" shown at (K) is reset with the power supply to the fuel pump 321 being turned off. The signal GO held in the MOD register 160 is also reset, whereby the AND gates 136, 140, 144 and 156 are disabled or blocked, resulting in the supply of drive pulses to the control means (12, 68, 62 and 90) being inhibited. Thus, overheating of the ignition device as well as fuel leakage from the injection can be positively prevented.

Figure 12:
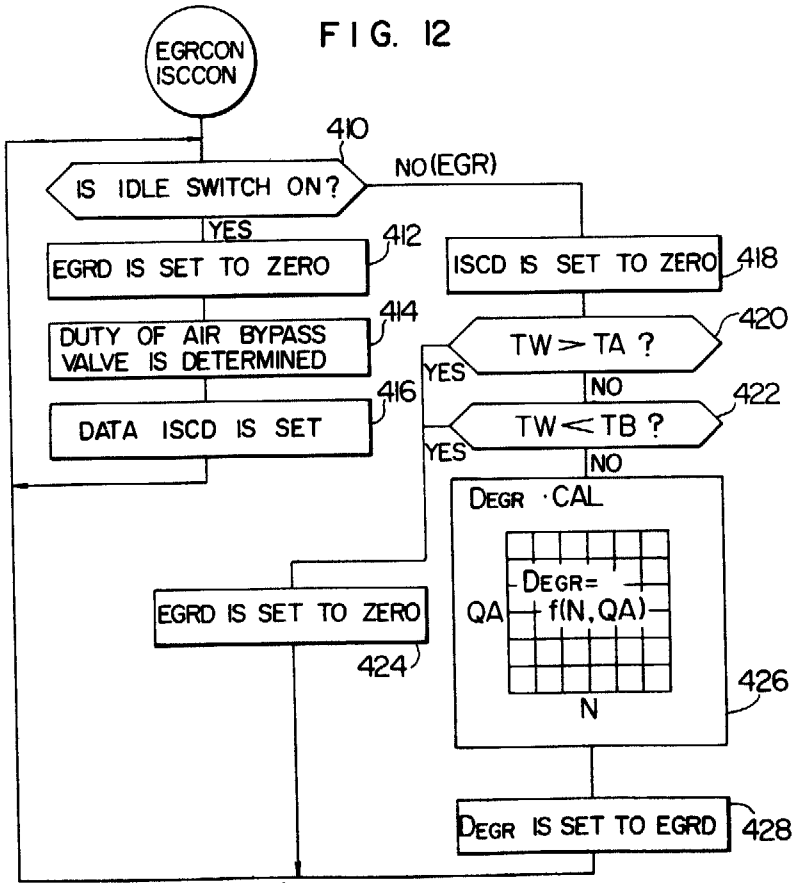
FIG. 12 is a flow chart to illustrate details of a BACKGROUND JOB program shown in FIG. 3.

From the step 322 shown in FIG. 9, the program proceeds to the BACKGROUND JOB 208 which is illustrated in detail in the flow chart of FIG. 12.

At a step 410, it is determined whether the IDLE-SW 148 is turned on. If so, recirculation of the exhaust gas is not to take place. Accordingly, the program proceeds to a step 412 where the register EGRD is set to zero. At a step 414, the duty cycle of the air bypass valve 62 is arithmetically determined in dependence on the temperature of the cooling water, the result of which is placed in the register ISCD at a step 416. In accordance with the value set at this register, air bypass flow to the engine is determined. Upon termination of the step 416, the step 410 is again executed. The above processing operation is repeated in the closed loop, so long as no service request for IRQ is issued to CPU.

On the other hand, when the IDLE-SW is turned off, the ISC operation is not carried out. Consequently, the register ISCD is set to zero at a step 418. In this state, the EGR quantity is arithmetically determined. To this end, it is determined whether the cooling water temperature TW is higher than a predetermined level TA °C. If the answer is affirmative, the program proceeds to a step 424 to set the register EGRD to zero in order to inhibit the EGR operation. In contrast, when the cooling water temperature TW is lower than TA °C., the program proceeds to a step 422 to determine whether the cooling water temperature TW is lower than a predetermined level TB °C. If so, then the EGR operation is also inhibited. Accordingly, the step 424 is executed to set the register EGRD to zero. The temperature level TA at the step 420 indicates the upper limit of TW with TB at the step 422 indicating the lower limit of TW. In the temperature range between TA and TB, the EGR operation is allowed to be carried out. Thus, when $TB \leqq TW \leqq TA$, the program proceeds to a step 426 where the quantity of EGR (e.g. exhaust gas recirculation) ($D_{EGR}$) is arithmetically determined on the basis of the intake air quantity QA and the engine rotation speed N through searching a corresponding map which is provided in ROM at addresses B700 to B7FF shown in FIG. 4. The retrieved value $D_{EGR}$ is set at the register EGRD at a step 428. As a consequence, the EGR value is opened to an opening degree determined on the basis of the value set at the register EGRD and the duty cycle preset at the register EGRP, whereby the EGR operation is now performed.

In the case of the flow chart shown in FIG. 12, the step 410 is reacquired upon end of the step 430 or step 416. Accordingly, the computer executes constantly the routine from the step 410 to the step 416 for controlling the air bypass valve 62 or the routine from the step 418 to the step 428 for controlling the EGR quantity.

In this manner, unless IRQ is issued, the program started from the start point 202 (FIG. 3) continues to be executed through the subprograms INITIALIZ 204 and MONIT 206 to the subprogram ISCCO for the BACKGROUND job or to the subprogram ERG CON.

The execution of the programs MONIT 206 as well as the program 208 for the BACKGROUND job can be interrupted by issuing interrupt request or IRQ. When the processing commanded by IRQ has been completed, the execution of the program as interrupted is reacquired.

Thus, according to the invention, in an engine control system utilizing a computer, the starting operation of engine can be effected through utilization of inertia torque available from the vehicle wheels.

We claim:

1. For use in an electronic control apparatus for controlling the operation of a combustion engine of a motor vehicle having an output shaft for producing an output torque for driving wheels of the vehicle and a starter motor for controllably rotating said output shaft, a method of operating said control apparatus for controlling the starting of said engine comprising the steps of:

(a) detecting whether or not said starter motor is in an energized state;

(b) in response to step (a) detecting that said starter motor is in an energized state, supplying starting control signals to said engine so that said engine is started thereby;

(c) in response to step (a) detecting that said starter motor is not in an energized state, determining whether prescribed operational characteristics of said engine indicate that said engine is being driven by the wheels of said vehicle; and (d) in response to step (c) determining that said engine is being drive by the wheels of said vehicle, supplying engine starting control signals to said engine so that said engine is started thereby.

2. A method according to claim 1, wherein step (b) comprises supplying first prescribed engine starting control signals to said engine upon detecting that said starter motor is in an energized state.

3. A method according to claim 2, wherein step (d) comprises supplying second prescribed engine starting control signals to said engine upon determining that said engine is being driven by the wheels of said vehicle.

4. A method according to claim 1, wherein step (c) comprises detecting whether said prescribed operational characteristics of said engine exceed first preset reference values.

5. A method according to claim 1, wherein said prescribed operational characteristics include at least one of engine speed and air intake quantity.

6. A method according to claim 5, wherein step (c) comprises measuring said at least one of the values of said engine speed and air intake quantity and comparing said measured values with preset reference values and indicating that said engine is being driven by the wheels of said vehicle in response to said measured values exceeding said preset values.

7. A method according to claim 1, wherein step (b) comprises generating signals for controlling the supply of fuel to said engine in response to detecting that said starter motor is in an energized state and thereby causing fuel to be supplied to said engine.

8. A method according to claim 1, wherein step (d) comprises generating signals for controlling the supply of fuel to said engine in response to determining that said engine is being driven by the wheels of said vehicle and thereby causing fuel to be supplied to said engine.

9. A method according to claim 1, wherein step (b) further comprises terminating the supply of said engine starting control signals to said engine upon detecting that said starter motor is no longer in an energized state.

10. A method according to claim 4, wherein step (d) further comprises terminating the supply of said engine starting control signals to said engine upon detecting that said prescribed operational characteristics of said engine exceed second preset reference values and causing normal engine operation control signals to be supplied to said engine.

11. A method according to claim 10, wherein step (d) further comprises terminating the supply of engine control signals to said engine upon detecting that said prescribed operational characteristics of said engine are less than third preset reference values.

12. A method according to claim 11, wherein said third preset reference values are less than said second preset reference values.

13. A method according to claim 1, wherein said electronic control apparatus includes a register for storing data indicating that said engine starting control signals are allowed to be supplied to said engine, and a gate for supplying said starting control signals to said engine in response to the data stored in said register.

14. For use in an electronic control apparatus for controlling the operation of a combustion engine of a motor vehicle having an output shaft for producing an output torque for driving wheels of the vehicle and a starter motor for controllably rotating said output shaft, a method of operating said control apparatus for controlling the starting of said engine comprising the steps of:

(a) initiating a starting operation of said engine in response to detecting said starter motor to be in an energized state or in response to detecting said engine to be driven by the wheels of said vehicle, and wherein step (a) includes one of the steps of:

(a-1) generating first prescribed fuel supply control signals for starting said engine in response to step (a) detecting said starter motor to be in an energized state; and (a-2) generating second prescribed fuel supply control signals for starting said engine in response to step (a) detecting said engine to be driven by the wheels of said vehicle.

15. A method according to claim 14, wherein step (a-1) comprises generating said first prescribed fuel supply control signal in accordance with the length of time that said starter motor has been in said energized state.

16. A method according to claim 14, wherein step (a-2) comprises generating said prescribed fuel supply control signal in accordance with a prescribed operational characteristic of said engine.

17. A method according to claim 16, wherein said prescribed operational characteristic constitutes engine speed.

18. A method according to claim 14, wherein step (a-2) comprises generating said second prescribed fuel supply control signal in accordance with the length of time that said starting operation is carried out.

19. A method according to claim 14, further including the step (b) of enabling a fuel pump for said engine to be controlled by either of said first and second prescribed fuel supply control signals.

20. A method according to claim 14, further comprising the step (b) of terminating the generation of said first prescribed fuel supply control signals for starting said engine upon detecting that said starter motor is no longer in an energized state.

21. A method according to claim 14, further comprising the step (b) of terminating the generation of said second prescribed fuel supply control signals for starting said engine upon detecting that said engine is no longer being drive by said wheels.

22. A method according to claim 14, wherein step (a) detects said engine to be drive by said wheels in response to prescribed operational characteristics of said engine exceeding preestablished reference values.

23. A method according to claim 22, wherein step (b) comprises terminating the generation of said second prescribed fuel supply control signals upon detecting that said prescribed operational characteristics of said engine exceed second preestablished reference values and causing normal operation fuel supply signals to be supplied to said engine.

24. A method according to claim 23, wherein step (b) comprises terminating the generation of said second prescribed fuel supply control signals upon detecting that said prescribed operational characteristics are less than third preestablished reference values.

25. A method according to claim 24, wherein said third preestablished reference values are less than said second preestablished reference values.

26. A method according to claim 14, wherein said electronic control apparatus includes a register for storing data indicating that said fuel supply control signals are allowed to be supplied to said engine, and a gate for supplying said fuel supply control signals to said engine in response to the data stored in said register.

* * * * *